US006928943B1

(12) United States Patent
Neubauer

(10) Patent No.: US 6,928,943 B1
(45) Date of Patent: Aug. 16, 2005

(54) BOAT PLUG KEY SYSTEM

(75) Inventor: Mark Neubauer, Phoenix, AZ (US)

(73) Assignee: Boat Plug, LLC, Phoenix, AZ (US)

( * ) Notice: Subject to any disclaimer, the term of this patent is extended or adjusted under 35 U.S.C. 154(b) by 0 days.

(21) Appl. No.: 10/774,219

(22) Filed: Feb. 5, 2004

(51) Int. Cl.[7] ..... B63B 13/00
(52) U.S. Cl. ..... 114/197
(58) Field of Search ..... 114/197

(56) References Cited

U.S. PATENT DOCUMENTS

| | | | | |
|---|---|---|---|---|
| 858,781 | A | 7/1907 | Benedict | |
| 3,812,810 | A * | 5/1974 | Moeller | 114/197 |
| 3,859,945 | A * | 1/1975 | Moeller | 114/197 |
| 3,998,353 | A | 12/1976 | Farelli | |
| 4,491,328 | A * | 1/1985 | Meyer | 273/403 |
| 4,516,515 | A | 5/1985 | Johnson | |
| 4,693,690 | A | 9/1987 | Henderson | |
| 4,986,777 | A * | 1/1991 | Preston | 440/88 L |
| 5,966,080 | A | 10/1999 | Bigsby | |
| 6,227,132 | B1 | 5/2001 | Garcia | |
| D451,468 | S | 12/2001 | Tobias | |
| 6,695,661 | B1 * | 2/2004 | Navagh | 441/74 |
| 2001/0047951 | A1 * | 12/2001 | O'Connor | 206/575 |

* cited by examiner

*Primary Examiner*—Sherman Basinger
(74) *Attorney, Agent, or Firm*—Schmeiser Olsen & Watts, LLP

(57) ABSTRACT

Embodiments of the present invention provide a boat plug key system for storing, installing, and removing a boat plug consist of a canister, a canister lid, and a boat plug. The use of a boat plug key system of the present invention reduces the probability of forgetting to install the boat plug when launching the boat or removing the boat plug when taking the boat out of the water and thereby reducing the probability of damage to the boat. The present invention also serves as a key corresponding to a key slot on the boat plug enabling the installation and removal of the boat plug. Additionally, a boat plug key system embodiment of the present invention acts as a key chain and a float creating greater convenience.

7 Claims, 3 Drawing Sheets

BOAT PLUG KEY SYSTEM

BACKGROUND OF THE INVENTION

1. Technical Field

This invention generally relates to a boat plug system and more particularly to a boat plug key system that also functions as a boat plug storing device, a reminder for installing and removing the boat plug, and a tool for installing and removing the boat plug.

2. State of the Art

Boats typically have drain holes located below the water line at the lowest portion of the hull to permit drainage of bilge water when the boat is removed from the water for transport on land or for dry storage. The drain hole is closed with a boat plug for plugging the hole while the boat operates on the water. Additionally, the plug is removed to drain the excess water within the boat.

The boat plug is a critical piece of boat equipment. Launching a boat without the boat plug installed will result in a costly error of sinking the boat. Conversely, if the boat plug is left installed in the drain hole when taken out of the water, the boat itself may suffer damage to the interior of the boat. For example, if a boat is left uncovered and it rains and the plug is still installed, then the water would not drain possibly causing damage to electrical equipment, promoting mildew and rot in the boat or the boats contents, and even causing structural damage should the water freeze. In addition to the problems of not installing or not removing the boat plug, typical boat plugs are often misplaced or stored in an inconvenient location on the boat, simply forgotten when launching the boat, and open to pranks or vandalism since the plug may be readily installed or removed by anyone.

A conventional solution to the problem of misplacing or inconveniently storing the boat plug is to attach the plug to an interior portion of the boat in a location near the drain hole. Attachment of the boat plug is conventionally accomplished by using a form of a tether, wherein one end of the tether is attached to the boat and an opposing end of the tether is attached to the boat plug. While the boat plug may be readily available, such a device does not serve as a reminder to install or remove the boat plug. Additionally, conventional boat plugs do not prevent a person from installing or removing the plug so as to vandalize the boat, and boat plugs with a type of securing device suffer from the same storing problems as do conventional boat plugs.

Accordingly, what is needed is a devise that solves the problems of reminding the boat operator to install and remove the boat plug and providing the means to do so, storing the plug in a convenient location, and preventing vandalism of the boat by making installation or removal of the plug available only to the boat operator.

DISCLOSURE OF THE INVENTION

The present invention provides a boat plug key system that overcomes the aforementioned issues of reminding the boat operator to install and remove the boat plug, storing the plug in a convenient location, and vandalism. Boat plug key system embodiments of the invention function as boat plug storage, boat plug installation and removal tools, and reminder devices to install or remove the boat plug.

Generally, the boat plug key system may comprise a canister, a canister cap, and a boat plug. Accordingly, although the invention may be readily adapted to a variety of embodiments of a boat plug key system of the invention for storing, installing, and removing boat plugs, the drawing figures depict a first boat plug key system embodiment of the invention for storing, installing, and removing boat plugs.

The canister may be a cylinder shape with one end open to receive a boat plug. With the boat plug in the canister, the canister lid may be coupled to the canister to retain the boat plug within the canister. The canister cap may comprise an overlapping portion, a circumferential bead, a canister engaging portion, cap shaft with a key chain aperture there through, a plug key, and a key guide. The boat plug may comprise a plug body, a plug aperture, a base washer, a collar with a recess, an upper washer, a lip, a key slot, a key head, a key washer, and a key shaft.

The present invention allows the stored boat plug to remain with the boat operator at all times when the boat is out of the water. The boat plug key system acts as a reminder since the boat key is attached to the canister cap forcing the boat operator to recall whether or not the plug has been installed. Additionally, as the boat is driven onto a trailer when the boat operator turns off the boat, the boat key is still attached to canister cap and reminds the boat operator to remove the plug. The use of a key enables the installation of the boat plug as the key works in conjunction with the key slot. The collar surrounds the key head and limits access to the boat plug to the proper plug key and thus limits the amount of vandalism that can occur on the boat plug. Since the plug key is part of the canister/canister cap, it is unlikely to be lost and benefits from the fact that the canister and cap float.

The boat plug key system also functions as a key chain for the boat key. The present invention may also function as a float. The canister cap and the canister may be coupled together in a watertight seal preventing leakage of water within the canister and creating the float. Thus, the canister and cap may serve the dual function of retaining the boat plug and serving as a float for the boat key.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention provides a boat plug key system that reminds the boat operator to install and remove the boat plug, stores the plug in a convenient location, and helps prevent vandalism. Boat plug key systems of the present invention generally comprise a canister, a canister cap, and a boat plug.

Figure 1:
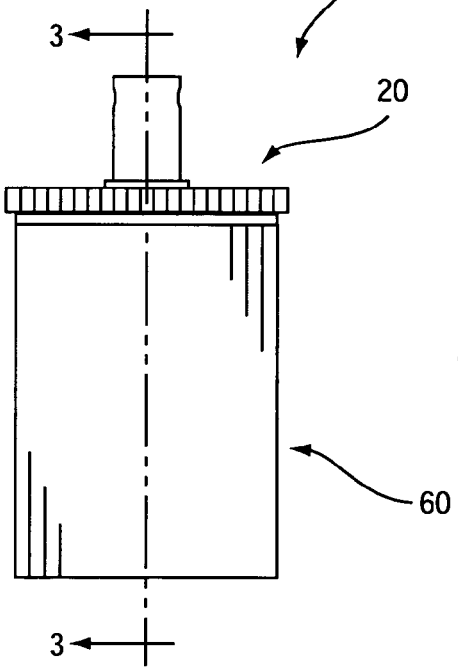
FIG. 1 is a side view of a boat plug key system according to an embodiment of the present invention.
Figure 2:
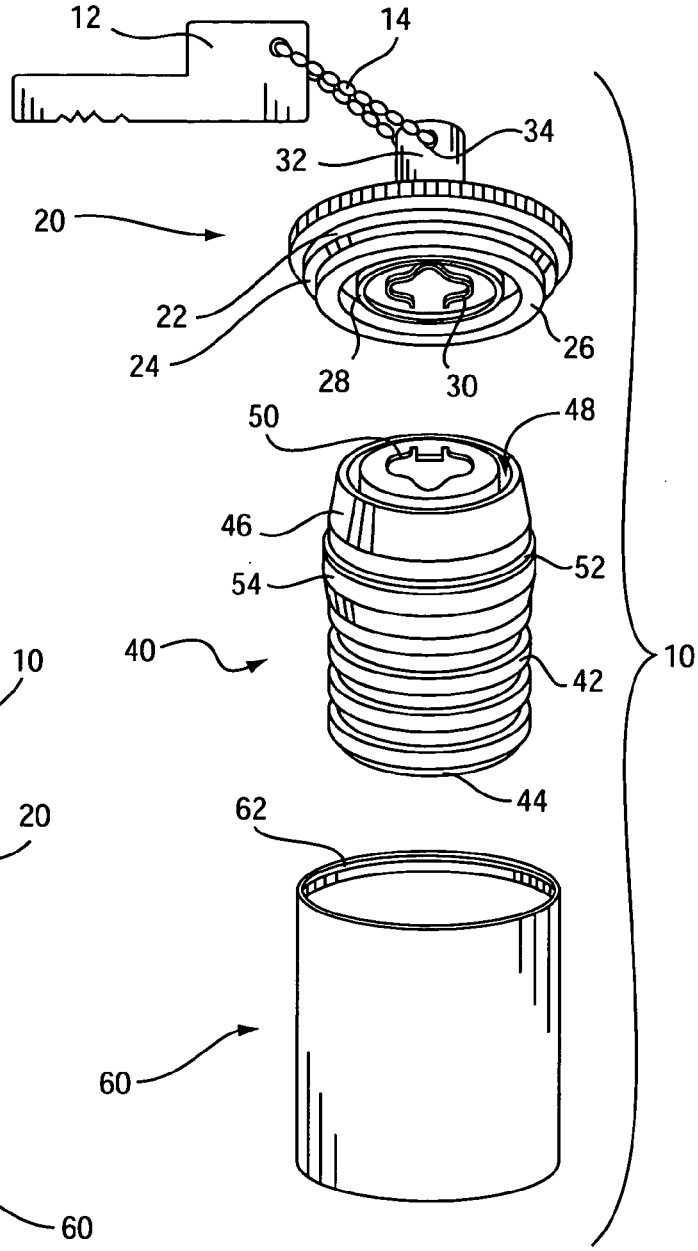
FIG. 2 is an exploded view of a boat plug key system configured according to an embodiment of the present invention.
Figure 3:
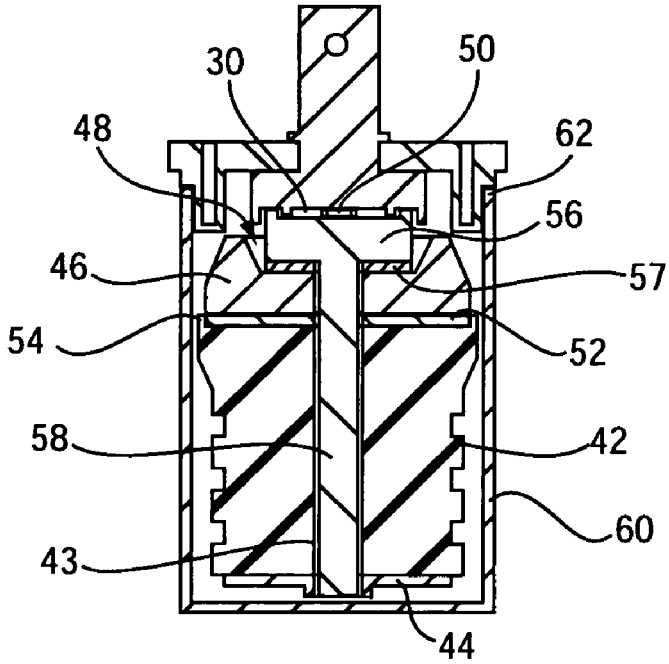
FIG. 3 is a section view of a boat plug key system taken along line 3—3 of FIG. 1 and showing the system in a stored position.

Accordingly, although the invention may be readily adapted to a variety of embodiments of a boat plug key system, with reference to FIGS. 1–3 boat plug key system 10 is an example of a boat plug key system of the invention. Boat plug key system 10 generally comprises canister 60, canister cap 20, and boat plug 40. As shown in FIG. 1, boat plug key system 10 is in a stored position with canister cap 20 removably coupled to canister 60.

Referring now to FIGS. 2 and 3, and for the exemplary purposes of this disclosure, components of boat plug key system 10 are shown. Canister 60 may be a hollow cylinder with an open end for receiving boat plug 40. Canister cap 20 may comprise overlapping portion 22, circumferential bead 24, canister engaging portion 26, key guide 28, plug key 30, cap shaft 32, and key chain aperture 34. Overlapping portion 22 is coupled to a bottom portion of canister cap 20 and is configured to overlap lip 62 of canister 60 when canister cap 20 is coupled to canister 60. Overlapping portion 22 may be coupled to canister engaging portion 26 by use of circumferential bead 24. Canister engaging portion 26 may be removably coupled to an inner portion of canister 60 by use of a press fit. The coupling of canister engaging portion 26 and canister 60 will be understood to not be limited to press fits, but may also use threads, clips, or any available form of coupling.

Key guide 28 and plug key 30 are also coupled to the bottom portion of canister cap 20. Plug key 30 is within the circumference of key guide 28. Key guide 28 is coupled within the circumference of canister engaging portion 26. Key guide 28 functions to create the proper alignment of plug key 30 and key slot 50, by fitting around key head 56, which may be in the shape of a sloped annulus, making it difficult to find a tool that can grasp key head 56, besides plug key 30.

Cap shaft 32 is coupled to a top portion of canister cap 20. Key chain aperture 34 runs through cap shaft 32 enabling chain 14 to be inserted through key chain aperture 34 and then coupled to boat key 12. The chain 14 could also be directly secured to the canister cap 20 and/or the canister 60.

Boat plug 40 may comprise plug body 42, plug aperture 43, base washer 44, collar 46, recess 48, key slot 50, upper washer 52, lip 54, key head 56, key washer 57, and key shaft 58. Plug body 42 is placed between collar 46 and base washer 44 such that plug aperture 43 that runs through each are aligned to receive key shaft 58. Key shaft 58 is inserted through plug aperture 43 and coupled to base washer 44, thus securing plug body 42 and collar 46 together. Upper washer 52 may be used between collar 46 and plug body 42 to prevent binding of collar 46 and plug body 42. Upper washer 52 is placed within lip 54 of plug body 42 and then key shaft 58 may be is inserted as aforementioned with optional key washer 57 placed between key head 56 and collar 46. Key head 56 and key shaft 58 are integral components. Key slot 50 is also integral to key head 56, and key slot 50 is configured to a receive plug key 30.

Figure 5:
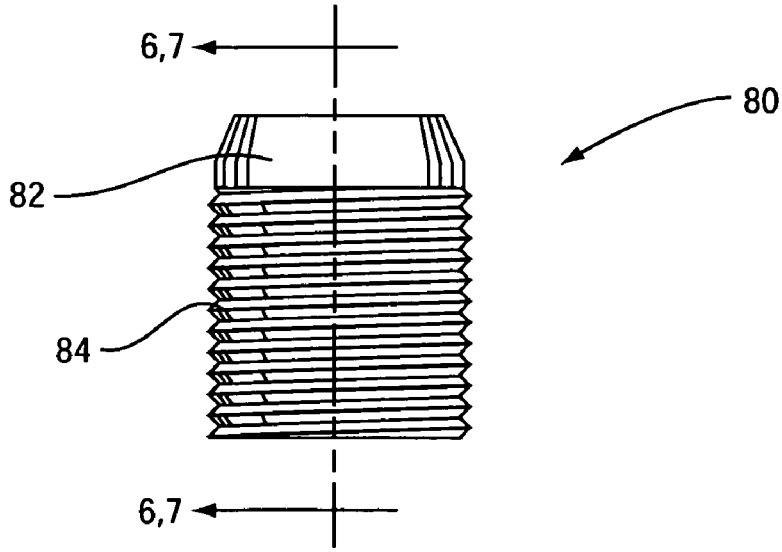
FIG. 5 is a side view of a boat plug configured according to an embodiment of the present invention.
Figure 6:
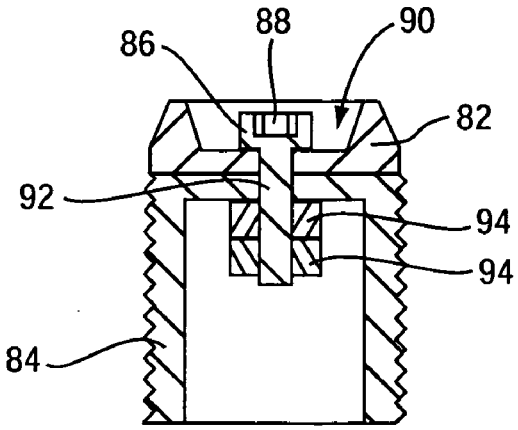
FIG. 6 is a section view of a boat plug taken along line 6—6 of FIG. 5 and showing an alternative boat plug according to an embodiment of the present invention.
Figure 7:
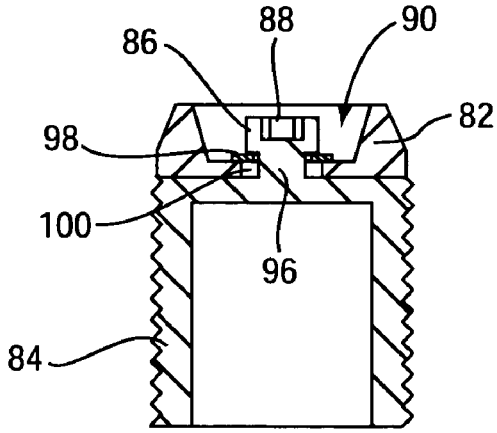
FIG. 7 is a section view of a boat plug taken along line 7—7 of FIG. 5 and showing an embodiment of the present invention with a key head integral with a plug body.

It will be understood by those of ordinary skill in the art that boat plug 40 may be of various functional forms. Referring to FIGS. 5–7, and for the exemplary purposes of this disclosure, boat plug 80 is depicted with a threaded plug body 84, collar 82, key head 86, key slot 88, recess 90, key shaft 92, and key nuts 94. Plug body 84 is an externally threaded cup with one open end. The closed end of plug body 84 is placed adjacent collar 82 and key shaft 92 used to couple collar 82 and plug body 84 together. Key nuts 94 are used to secure key shaft 92. Recess 90 of collar 82 is configured to receive key head 86 with integral key slot 88. Again, key head 86 and key shaft are also integral components. Neck 96, snap washer 98 and collar aperture 100 reflect a variation of the threaded boat plug. Neck 96 replaces key shaft 92 by making plug body 84 and key head 86 integral. Neck 96 allows key head 86 to extend into recess 90 and provides access to key slot 88. Key head 86 extends into recess 92 by use of collar aperture 100, which has a diameter to allow key head 86 to readily pass through.

It will be understood by those of ordinary skill in the art that the invention is not limited to boat plug key system 10 and its components disclosed herein, as virtually any boat plug key system and components known in the art consistent with the intended operation of a boat plug key system may be utilized. Accordingly, for example, although particular boat plug key system, canisters, canister caps, boat plugs, and other components are disclosed, such components may comprise any shape, size, style, type, model, version, measurement, material, and/or the like as is known in the art for such components consistent with the intended operation of a boat plug key system of the invention. It will also be understood by those of ordinary skill in the art that the invention is not limited to use of any specific components, provided that the components selected are consistent with the intended operation of a boat plug key system of the invention.

The components defining any boat plug key system embodiment of the invention may be formed of any of many different types of materials or combinations thereof that can readily be formed into shaped objects provided that the components selected are consistent with the intended mechanical operation of a dolly of the invention. For example, the components may be formed of the following types of materials and/or any combinations thereof: rubber, such as synthetic, natural, and/or other like materials; composites such as fiberglass, carbon-fiber, and/or other like materials; polymers, such as plastic, polycarbonates, tinted polycarbonates, PVC plastic, ABS plastic, polystyrenes, nylon, phenolics, and/or other like materials; elastomers, such as thermoplastic elastomers and/or other like materials; metals, such as zinc, magnesium, copper, iron, steel, and/or other like materials; and/or alloys, such as aluminum and/or other like materials.

The components defining any boat plug key system embodiment of the invention may be purchased pre-manufactured or manufactured separately and then assembled together. However, any or all of the components may be manufactured simultaneously and integrally joined with one another. Manufacture of these components separately or simultaneously may involve extrusion, pultrusion, injection molding, resin transfer molding, casting, milling, cutting, welding, soldering, riveting, punching, stamping, and/or the like. If any of the components are manufactured separately, they may then be coupled with one another in any manner known in the art, such as with adhesive, a weld, a fastener (e.g. a bolt, a screw, a rivet, a securing pin), any combination thereof, and/or the like for example, depending on, among other considerations, the particular material forming the components. Other possible steps might include sand blasting, polishing, powder coating, and/or painting the components for example.

Figure 4:
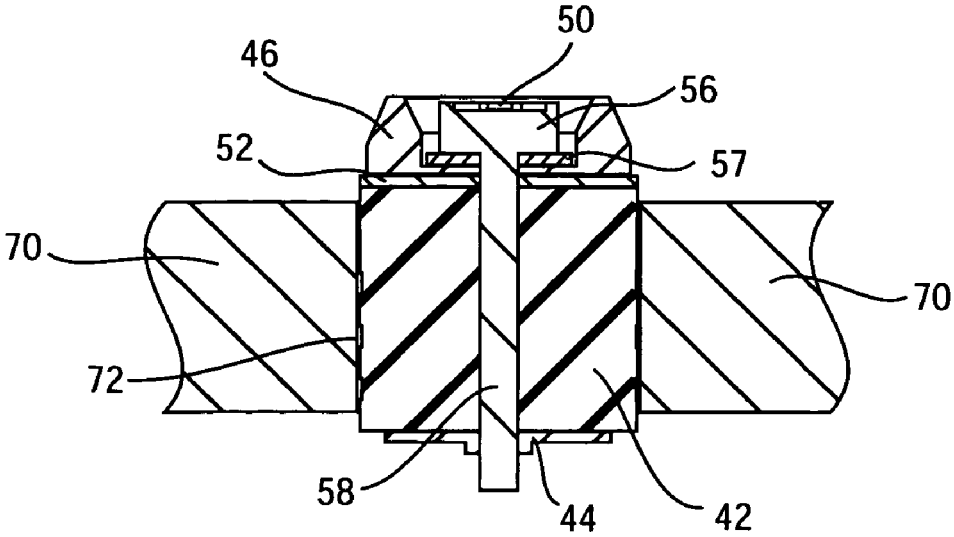
FIG. 4 is a section view of a boat plug installed within a hole of a wall.

In describing the use of the present invention further, although the invention may be readily adapted to a variety of embodiments of a boat plug key system, with reference to FIG. 4 and for the exemplary purposes of this disclosure, boat plug key system 10 is shown in use with a wall 70. Wall 70 may be the wall of the hull of a boat. With in wall 70 is hole 72 for draining water from the boat. Rotating key head 56, using a key in conjunction with key slot 50, rotates key shaft 58. Base washer 44 moves linearly along the axis of key shaft 58. The pressure directed between collar 46 and base washer 44 deforms plug body 42 and expands it to fill hole 72. The expansion of plug body 42 may be so radical as to render the plug immovable with even large amounts of pressure similar to pressure it would face under the water on a large, heavy watercraft. The release of the boat plug would require the use of a key and turning key head 56 in the opposite direction.

Now, referring to FIGS. 1–3, after removing boat plug 40, it can be stored by simply placing boat plug 40 into canister 60. Canister cap 20 can now be pressed onto canister 60, while ensuring that plug key 30 and key slot 50 are aligned. The seal between canister cap 20 and canister 60 may be so effective as to create a watertight seal. This would allow boat plug key system 10 to float if dropped into the water, with or without boat plug 40 within canister 60. Additionally, the fact that a key must be used is vital to protecting the boat plug and boat itself from vandalism. This vandalism may be in similar form as taking the boat plug out while the boat is docked and allowing the boat to sink or even installing the boat plug so as to not allow any drainage of water resulting in damages to the boat. Plug key 30 and key slot 50, used in conjunction with collar 46 and recess 48, makes it more difficult than conventional boat plugs to remove or install. Plug key and key slot can vary in shape such as hex shape, flat-head or Phillips screw driver, or any other shape, regular or irregular or as deemed appropriate.

Referring to FIG. 2, boat plug key system 10 may be used as a key chain. This serves as a reminder to the boat operator to install or remove boat plug 40. As is common when launching a boat by use of a dock, the boat plug 40 is installed at the last moment to allow any gas, oil, or water to drain out, helping to prevent a fire hazard. With boat key 12 attached to the boat plug key system 10, when the boat operator proceeds to start the boat engine, the fact that the key chain is boat plug key system 10 serves to remind the boat operator as to whether or not boat plug 40 has been installed. Upon taking the boat out of the water, the engine must be turned off and the key removed. The removal of boat key 12 from the ignition will remind the boat operator to remove plug by continuing to hold boat plug key system 10 as the key chain. The storage of boat plug 40 is very convenient and always accessible as it is always with boat key 12. No matter where the boat is or where it is traveling to or even who is driving the boat, the plug will stay with the key and create greater convenience.

The present invention is particularly well-suited for use with boats and other forms of watercraft. However, it will be understood by those of ordinary skill in the art that the invention is not limited to uses relating to boats, watercrafts, and the like. Rather, any description relating to boats, watercrafts, and the like is for the exemplary purposes of this disclosure, and those of ordinary skill in the art will also understand that the invention may also be used with similar results in a variety of applications for any type of flow prevention from one side of a barrier to the other, such as fluids, gases, granular material, and the like.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation. Similarly, any steps or sequence of steps of methods indicated herein are given as examples of possible steps or sequence of steps and not as limitations.

What is claimed is:

1. A device for storing, installing, and removing a boat plug comprising:

a boat plug;

a canister configured to receive the boat plug;

a canister cap removably coupled to the canister to retain the boat plug within the canister comprising a plug key for installing and removing the boat plug from a drain hole of a watercraft, said canister cap further comprises a key guide to ensure the key engages a desired key slot properly; and a key chain coupled to the canister.

2. The invention of claim 1, wherein the boat plug comprises said key slot, a key head coupled to a key shaft, a plug body, a collar, a recess, and a base washer.

3. The invention of claim 2, wherein the key slot is integral to the key head, the key slot configured to receive a plug key.

4. The invention of claim 3, wherein each the collar, the plug body, and the base washer have a plug aperture for receiving the key shaft extending from the collar through the plug body, and to the base washer, such that when the key shaft is rotated, the base washer travels linearly along a center line of the key shaft.

5. The invention of claim 4, wherein the plug body is a deformable material that expands diameterally to plug a drain hole as the base washer and the collar apply pressure on opposing ends of the plug body and shrinks diametrally when the pressure is reduced.

6. The invention of claim 2, wherein the recess is integral to the collar and is configured to receive the key head and limit access to the key slot.

7. The invention of claim 6, wherein the collar is configured to engage a key guide of the canister cap to align the plug key with the key slot.

* * * * *